US011753213B2

(12) United States Patent
Hohl et al.

(10) Patent No.: US 11,753,213 B2
(45) Date of Patent: Sep. 12, 2023

(54) SEALING STRUCTURES FOR CLOSURE

(71) Applicant: Silgan White Cap LLC, Downers Grove, IL (US)

(72) Inventors: Wayne Hohl, Mokena, IL (US); Dennis Szczesniak, Lemont, IL (US); Darren R. Neputy, Palos Hills, IL (US); Jack Pierce, Downers Grove, IL (US); Dustin Vance, Lombard, IL (US); Sungsuk Steve Kim, Batavia, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 28 days.

(21) Appl. No.: 17/362,010

(22) Filed: Jun. 29, 2021

(65) Prior Publication Data

US 2021/0394968 A1 Dec. 23, 2021

Related U.S. Application Data

(63) Continuation of application No. PCT/US2021/037770, filed on Jun. 17, 2021.

(60) Provisional application No. 63/042,806, filed on Jun. 23, 2020.

(51) Int. Cl.
*B65D 41/04* (2006.01)

(52) U.S. Cl.
CPC ..... *B65D 41/0407* (2013.01)

(58) Field of Classification Search
CPC ..... B65D 41/0407; B65D 41/325; B65D 41/3428; B65D 41/0421; B65D 51/1661; B65D 2251/023; B65D 41/005
See application file for complete search history.

(56) References Cited

U.S. PATENT DOCUMENTS

| | | | |
|---|---|---|---|
| D57,050 | S | 2/1921 | Ingram |
| D57,054 | S | 2/1921 | Ingram |
| 1,495,324 | A | 5/1924 | Hammer |
| D73,696 | S | 10/1927 | Green |
| 1,667,003 | A | 4/1928 | Hardiman |
| D196,082 | S | 8/1963 | Stull |
| 3,812,994 | A | 5/1974 | Feldman |
| 4,981,230 | A | 1/1991 | Marshall et al. |

(Continued)

FOREIGN PATENT DOCUMENTS

| | | |
|---|---|---|
| JP | 2003-024234 | 1/2003 |
| KR | 10-2007-0052735 | 5/2007 |
| WO | WO 2013/077099 | 5/2013 |

OTHER PUBLICATIONS

"38 MM Lead Bore Seal," Jul. 22, 2017, accessed on Internet on Aug. 2, 2019 [http://plastics.silgan-closures.com/eu_en/product/311], 1 page.

(Continued)

*Primary Examiner* — Shawn M Braden
(74) *Attorney, Agent, or Firm* — Reinhart Boerner Van Deuren s.c.

(57) ABSTRACT

Described is one or more embodiments of closures that include a pressure-relieving feature in a third plug. In one embodiment, the pressure-relieving feature is a gap within the third plug. In another embodiment, the pressure-relieving feature includes one or more recesses within inner surface of the third plug, thereby providing fluid communication between an outer surface of the second plug and the ambient air outside the closure.

20 Claims, 14 Drawing Sheets

(56) References Cited

U.S. PATENT DOCUMENTS

| | | | |
|---|---|---|---|
| 5,385,252 | A | 1/1995 | Hidding et al. |
| D359,682 | S | 6/1995 | Miller |
| 5,487,481 | A | 1/1996 | Sander et al. |
| 5,673,809 | A | 10/1997 | Ohmi et al. |
| 5,743,420 | A | 4/1998 | Loffler et al. |
| 5,913,437 | A | 6/1999 | Ma |
| D443,513 | S | 6/2001 | Goettner |
| D451,393 | S | 12/2001 | Gerhart et al. |
| 6,405,886 | B1 | 6/2002 | Gearhart et al. |
| D460,357 | S | 7/2002 | Kras et al. |
| D465,731 | S | 11/2002 | Brant et al. |
| 6,581,793 | B1 | 6/2003 | Racine et al. |
| D481,314 | S | 10/2003 | Noonan |
| 6,677,397 | B1 | 1/2004 | Baranowski et al. |
| 6,766,916 | B2 | 7/2004 | Ma |
| 6,783,015 | B1 | 8/2004 | Bosl et al. |
| 6,964,346 | B1 | 11/2005 | Taber et al. |
| 6,981,602 | B2 | 1/2006 | Ma et al. |
| D515,429 | S | 2/2006 | Pace |
| D518,717 | S | 4/2006 | German |
| D529,804 | S | 10/2006 | Lohrman |
| D534,802 | S | 1/2007 | German |
| 7,306,108 | B2 | 12/2007 | Cleevely |
| 7,314,146 | B2 | 1/2008 | Mavin |
| D574,240 | S | 8/2008 | Szczesniak |
| 7,413,097 | B1 | 8/2008 | Adams |
| D578,889 | S | 10/2008 | Sadiq |
| D583,237 | S | 12/2008 | Fuchs |
| D606,401 | S | 12/2009 | Kamath et al. |
| D606,864 | S | 12/2009 | Robinson |
| D632,958 | S | 2/2011 | Fuchs |
| D634,200 | S | 3/2011 | Taber et al. |
| 8,066,133 | B2 | 11/2011 | Takamatsu et al. |
| D687,299 | S | 8/2013 | Peykoff et al. |
| D688,128 | S | 8/2013 | Krause |
| D693,685 | S | 11/2013 | Ramsey et al. |
| D723,370 | S | 3/2015 | Medlin |
| D723,919 | S | 3/2015 | Taber et al. |
| D731,238 | S | 6/2015 | Kalaouze, Jr. |
| D762,115 | S | 7/2016 | Corvaglia et al. |
| D789,201 | S | 6/2017 | Yu |
| D792,219 | S | 7/2017 | Bueno Nunez |
| D824,257 | S | 7/2018 | Wood |
| D836,442 | S | 12/2018 | Wood et al. |
| D838,171 | S | 1/2019 | Wood et al. |
| D863,963 | S | 10/2019 | Garcia |
| 2001/0027957 | A1 | 10/2001 | Kano |
| 2002/0158037 | A1 | 10/2002 | Kano et al. |
| 2003/0132244 | A1 | 7/2003 | Birkmayer et al. |
| 2007/0051690 | A1 | 3/2007 | Hidding |
| 2008/0067142 | A1 | 3/2008 | Druitt |
| 2008/0087625 | A1 | 4/2008 | Kumata |
| 2008/0173611 | A1 | 7/2008 | Neputy |
| 2009/0008392 | A1 | 1/2009 | De Cleir |
| 2011/0024423 | A1 | 2/2011 | Erspamer et al. |
| 2012/0031871 | A1 | 2/2012 | Molinaro et al. |
| 2013/0200036 | A1* | 8/2013 | Delage ..... B65D 41/0421 215/344 |
| 2013/0205718 | A1 | 8/2013 | Kapolas |
| 2013/0313218 | A1 | 11/2013 | Cox et al. |
| 2014/0158660 | A1 | 6/2014 | Wood et al. |
| 2014/0263335 | A1 | 9/2014 | Taber et al. |
| 2016/0332783 | A1 | 11/2016 | Kim |
| 2017/0021978 | A1 | 1/2017 | Keener |
| 2017/0050350 | A1 | 2/2017 | Falzoni et al. |
| 2018/0044079 | A1 | 2/2018 | Van de Grift et al. |
| 2018/0057227 | A1 | 3/2018 | Bartow |
| 2018/0079552 | A1 | 3/2018 | Ayeni |
| 2018/0162605 | A1 | 6/2018 | Zeng et al. |
| 2018/0370701 | A1 | 12/2018 | Maguire |
| 2019/0009953 | A1 | 1/2019 | Edie et al. |
| 2019/0016510 | A1 | 1/2019 | Woodley |
| 2019/0062007 | A1 | 2/2019 | Kim |
| 2019/0118989 | A1 | 4/2019 | Kim |
| 2019/0337691 | A1 | 11/2019 | Kim |
| 2019/0337692 | A1* | 11/2019 | Kim ..... B65D 41/3428 |
| 2019/0344933 | A1 | 11/2019 | Kim |
| 2020/0223597 | A1* | 7/2020 | Neputy ..... B65D 41/3428 |
| 2020/0331663 | A1* | 10/2020 | Edie ..... B65D 41/3423 |

OTHER PUBLICATIONS

"38 MM Lead Overcap," Jul. 22, 2017, accessed on Internet on Aug. 2, 2019 [http://plastics.silgan-closures.com/eu_en/product/313], 1 page.

Turbosquid, "Plastics Bottle Screw Cap," Apr. 28, 2014, accessed on Internet Dec. 5, 2019, [https://www.turbosquid.com/FullPreview/Index.cfm/ID/817447], 1 page.

Silgan Closures, "38MM 3 Lead Wadded," Aug. 6, 2017, accessed on Internet Dec. 5, 2019, [http://plastics.silgan-closures.com/eu_en/product/310], 1 page.

International Search Report and Written Opinion for International Application No. PCT/US2021/037770, dated Sep. 24, 2021, 11 pages.

* cited by examiner

SEALING STRUCTURES FOR CLOSURE

CROSS-REFERENCE TO RELATED PATENT APPLICATION

The present application is a continuation of International Patent Application No. PCT/US2021/037770, filed on Jun. 17, 2021, which claims the benefit of and priority to U.S. Provisional Application No. 63/042,806, filed on Jun. 23, 2020, which is incorporated herein by reference in its entirety.

BACKGROUND OF THE INVENTION

The present disclosure relates generally to the field of closures for containers. The present disclosure relates specifically to a closure for a container having a pressure-relieving structure to relieve pressure from the container the closure is affixed to.

SUMMARY OF THE INVENTION

In one aspect, this disclosure relates to a closure for a container. The closure includes a generally circular top panel having an upper surface, a lower surface and an outer periphery, a vertical axis around which the top panel is centered, an outer cylindrical wall extending from an outer periphery of the top panel, a cylindrical first plug extending a first depth downward from the lower surface of the top panel, the first plug being radially closer to the vertical axis than the outer periphery of the top panel, a cylindrical second plug extending a second depth downward from the lower surface of the top panel, the second plug being radially further from the vertical axis than the first plug, the first depth of the first plug being greater than the second depth of the second plug, a cylindrical third plug extending a third depth downward from the lower surface of the top panel, the third plug being radially further from the vertical axis than the second plug, the third depth of the third plug being greater than the second depth of the second plug and the third depth of the third plug being less than the first depth of the first plug, and a gap within the third plug, wherein the gap provides fluid communication between the second plug and ambient air external to the outer cylindrical wall. In a specific embodiment the gap defines a circumferential length less than 0.125 inches with respect to the vertical axis, and more specifically between 0.04 inches and 0.08 inches.

According to another embodiment, the closure includes a container and a closure affixed to the container neck. The container defines an internal volume and includes a container neck having an opening that provides fluid communication between the internal volume and an exterior of the container. The container neck includes an interior surface, an opposing exterior surface, and a top surface extending between the interior surface and the exterior surface. The closure includes a generally circular top panel having an upper surface, a lower surface and an outer periphery, an outer cylindrical wall extending from an outer periphery of the top panel, a cylindrical first plug extending a first depth downward from the lower surface of the top panel, the first plug being radially closer to the vertical axis than the outer periphery of the top panel, a surface defined by the first plug that interfaces against the interior surface of the container neck, a cylindrical second plug extending a second depth downward from the lower surface of the top panel, the second plug being radially further from the vertical axis than the first plug, the first depth of the first plug being greater than the second depth of the second plug, a surface defined by the second plug that interfaces against the top surface of the container neck, a cylindrical third plug extending a third depth downward from the lower surface of the top panel, the third plug being radially further from the vertical axis than the second plug, the third depth of the third plug being greater than the second depth of the second plug and the third depth of the third plug being less than the first depth of the first plug, and a surface defined by the third plug interfaces against the exterior surface of the container neck. The third plug includes a gap that provides fluid communication between the surface (e.g., the outer peripheral surface) of the second plug and ambient air external to the container.

According to another embodiment, the closure includes a generally circular top panel having an upper surface, a lower surface and an outer periphery, a vertical axis around which the top panel is centered, an outer cylindrical wall extending from an outer periphery of the top panel, a cylindrical first plug extending a first depth downward from the lower surface of the top panel, the first plug being radially closer to the vertical axis than the outer periphery of the top panel, a cylindrical second plug extending a second depth downward from the lower surface of the top panel, the second plug being radially further from the vertical axis than the first plug, the first depth of the first plug being greater than the second depth of the second plug, a cylindrical third plug extending a third depth downward from the lower surface of the top panel, the third plug being radially further from the vertical axis than the second plug, the third depth of the third plug being greater than the second depth of the second plug and the third depth of the third plug being less than the first depth of the first plug. The third plug includes an interior surface that faces towards the vertical axis and a recess defined by the interior surface of the third plug. The recess provides fluid communication between the second plug and ambient air external to the outer cylindrical wall.

According to another embodiment, the closure includes a generally circular top panel having an upper surface, a lower surface and an outer periphery, a vertical axis around which the top panel is centered, an outer cylindrical wall extending from an outer periphery of the top panel, a cylindrical first plug extending a first depth downward from the lower surface of the top panel, the first plug being radially closer to the vertical axis than the outer periphery of the top panel, a cylindrical second plug extending a second depth downward from the lower surface of the top panel, the second plug being radially further from the vertical axis than the first plug, the first depth of the first plug being greater than the second depth of the second plug, a cylindrical third plug extending a third depth downward from the lower surface of the top panel, the third plug being radially further from the vertical axis than the second plug, the third depth of the third plug being greater than the second depth of the second plug and the third depth of the third plug being less than the first depth of the first plug. The third plug includes an interior surface, a lower surface that faces away from the top panel, and a corner surface that extends between the interior surface and the lower surface. The corner surface is configured to interface against a corner of a container neck when the closure is affixed to the container neck.

According to another embodiment, the closure includes a generally circular top panel having an upper surface, a lower surface and an outer periphery, a vertical axis around which the top panel is centered, an outer cylindrical wall extending from an outer periphery of the top panel, a cylindrical first plug extending a first depth downward from the lower surface of the top panel, the first plug being radially closer to the vertical axis than the outer periphery of the top panel, a cylindrical second plug extending a second depth downward from the lower surface of the top panel, the second plug being radially further from the vertical axis than the first plug, the first depth of the first plug being greater than the second depth of the second plug, a cylindrical third plug extending a third depth downward from the lower surface of the top panel, the third plug being radially further from the vertical axis than the second plug, the third depth of the third plug being greater than the second depth of the second plug and the third depth of the third plug being less than the first depth of the first plug. An interior surface of the third plug faces towards the vertical axis. A protrusion that extends from a lower portion of the third plug towards the axis.

Additional features and advantages will be set forth in the detailed description which follows, and in part will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide further understanding, and are incorporated in, and constitute a part of this specification. The drawings illustrate one or more embodiments and together with the description serve to explain principles and operation of the various embodiments.

DETAILED DESCRIPTION

Figure 1:
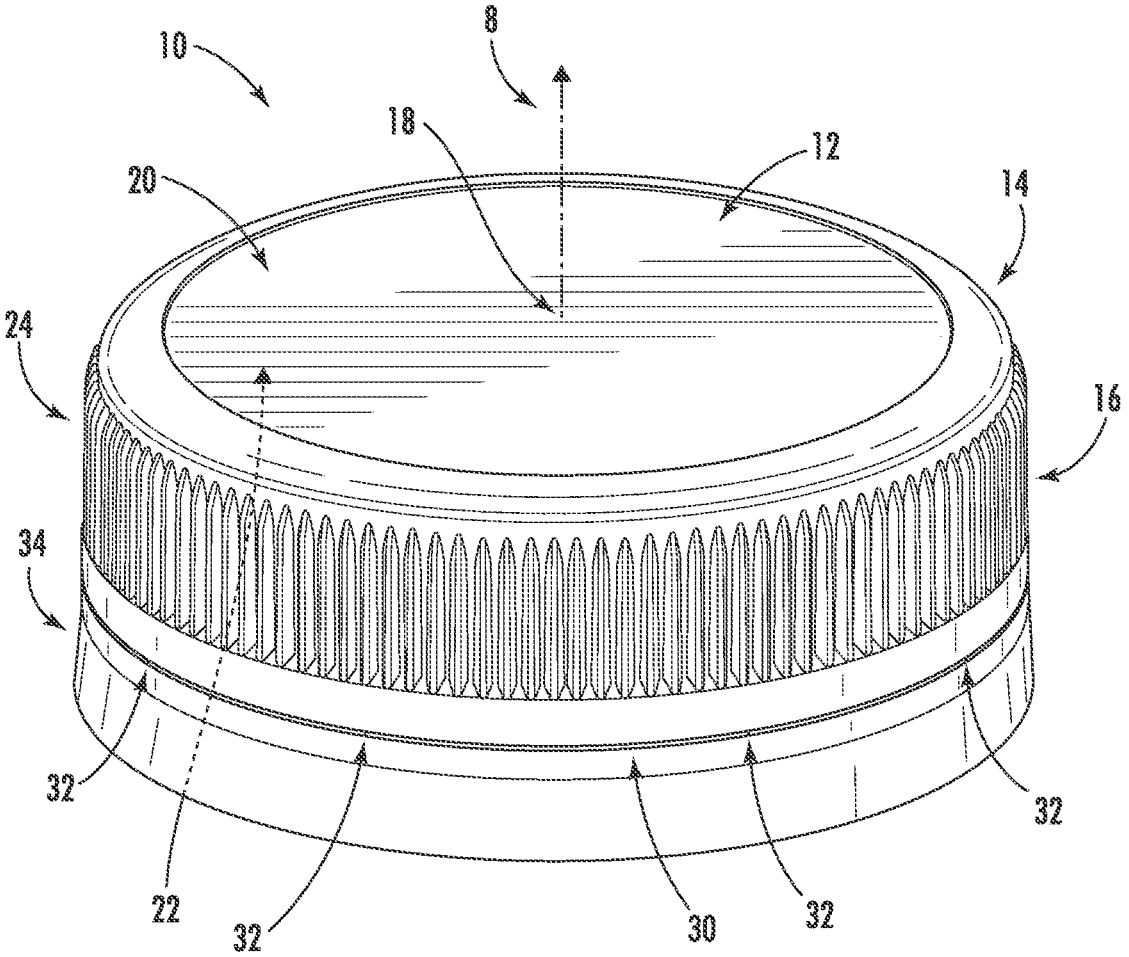
FIG. 1 is a perspective view of a closure, according to an exemplary embodiment.
Figure 2:
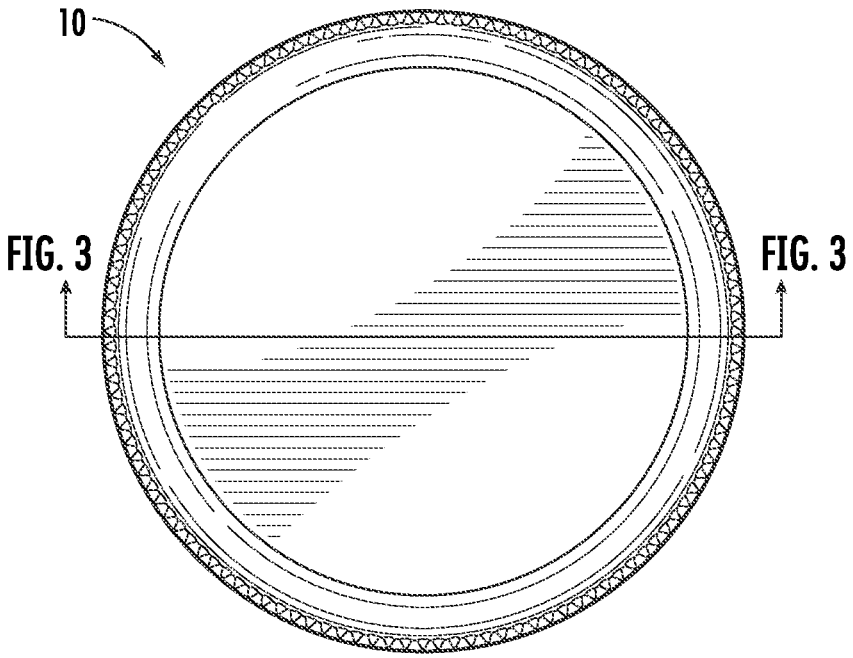
FIG. 2 is a top view of the closure of FIG. 1, according to an exemplary embodiment.

This disclosure provides a description for various embodiments of closures with a pressure-relieving structure. Applicant has observed that different embodiments of the same three-plug closures have a high variance for how much pressure is required to break the seal of the outer-most plug. Accordingly, Applicant has designed one or more closures with plugs that interface against an interior and exterior, and optionally a third plug that interfaces with the upper surface of the container neck. The three-plug closures provide pressure-relieving features to the outer-most plug, thereby permitting closures to be designed to have a more consistent amount of seal-breaking pressure for the interface between the closure and the container to which the closure is affixed. In one or more embodiments, the amount of pressure to break the seal is lower than is demonstrated by closures that do not include the features in this disclosure. Even with the incorporated pressure relieving feature, the closure plug continues to provide structural support to the E-wall of the container neck to stop and/or slow the E-wall deforming (e.g., such as from a circle to an oval).

Referring first to FIGS. 1-8, various aspects of a closure for a container, shown as closure 10, are shown. A generally circular top panel 12 is centered around rotational axis 8 of closure 10, which passes through center 18 of top panel 12. Top panel 12 defines upper surface 20 and opposing lower surface 22. Top panel 12 is centered on axis 8. A wall, shown as outer cylindrical wall 16, extends downwardly from lower surface 22 of top panel 12 at outer periphery 14 of top panel 12. Cylindrical wall 16 defines outer surface 28, which faces away from axis 8, and an opposing inner surface 26, which faces towards axis 8.

Grip portion 24 of cylindrical wall 16 comprises one or more knurls. Retention band 34 is coupled to cylindrical wall 16 via frangible connections 32. Frangible connections 32 are arranged at weakened section 30 of closure 10, between cylindrical wall 16 and retention band 34. When closure 10 is removed from a container for the first time, frangible connections 32 break, disconnecting cylindrical wall 16 from retention band 34.

Figure 3:
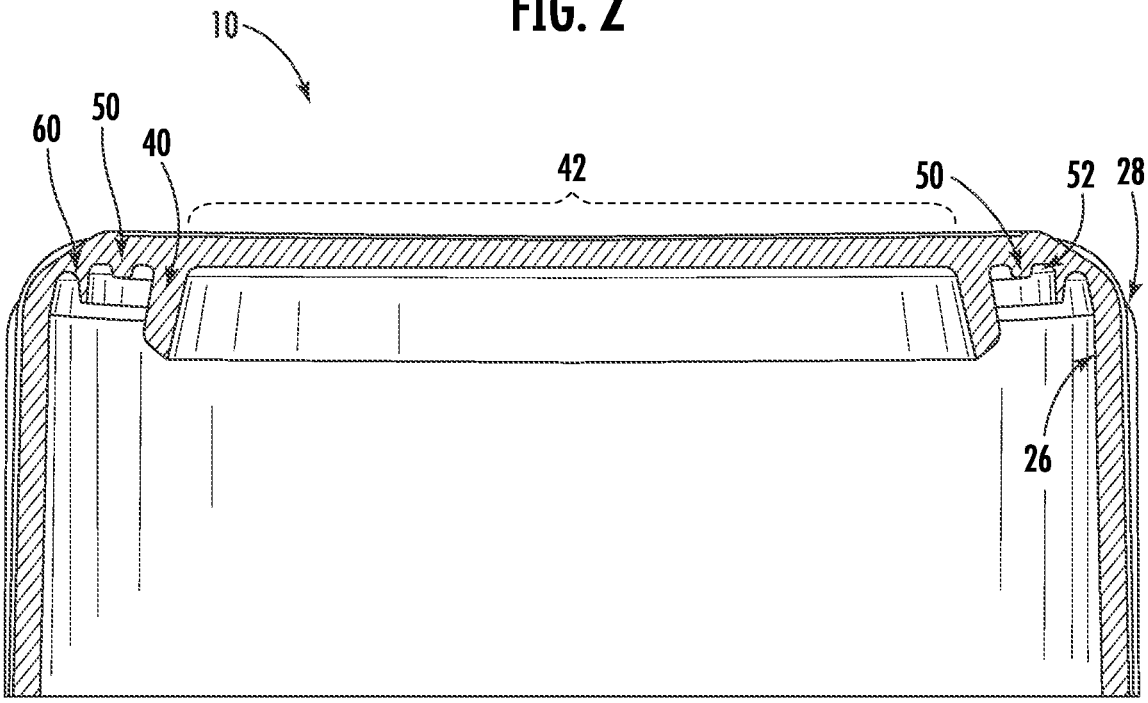
FIG. 3 is a cross-sectional view of the closure of FIG. 2 taken along the line 3-3 in FIG. 2, according to an exemplary embodiment.

Turning to FIG. 3 in particular, closure 10 includes first cylindrical wall 40, second cylindrical wall 50, and third cylindrical wall 60, each of which extend downwardly from lower surface 22 of top panel 12. First cylindrical wall 40 extends circumferentially around axis 8. Second cylindrical wall 50 extends circumferentially around axis 8 and is radially further from axis 8 than first cylindrical wall 40.

In a specific embodiment, first cylindrical wall 40 is a first cylindrical plug that extends depth 44 downward from lower surface 22 of top panel 12. In a specific embodiment, second cylindrical wall 50 is a second cylindrical plug that extends depth 54 downward from lower surface 22 of top panel 12. In a specific embodiment, third cylindrical wall 60 is a third cylindrical plug that extends depth 61 downward from lower surface 22 of top panel 12.

In a specific embodiment, the depth 44 of the first cylindrical wall 40 is greater than the depth 54 of the second cylindrical wall 50. In a specific embodiment, depth 61 is greater than the depth 54 of the second wall 50, and the depth 61 is less than the depth 44 of the first wall 40.

In a specific embodiment, the first wall 40 is radially closer to the vertical axis 8 than the outer periphery 14 of the top panel 12. In a specific embodiment, second wall 50 is radially further from the vertical axis 8 than the first wall 40. In a specific embodiment, the plurality of third plug segments 66 extend the third depth 61 downward from the lower surface 22 of the top panel 12, and the plurality of third plug segments 66 are radially further from the vertical axis 8 than the second plug 50.

In a specific embodiment, each of the plurality of third plug segments 66 extend circumferentially around the closure 10 at the same radius from the vertical axis 8. In a specific embodiment, each of the plurality of third plug segments 66 are the same radius from the vertical axis 8. In a specific embodiment, closure 10 includes a plurality of gaps 62, and more specifically closure 10 includes three gaps 62 that provide fluid communication between the second wall 50 and ambient air external to the closure 10 (e.g., external to the outer cylindrical wall when the closure is tightly coupled to a container). In a specific embodiment, the plurality of gaps 62 are evenly circumferentially spaced around the closure 10 with respect to the axis 8. In a specific embodiment, closure 10 includes a single third plug segment 66 and a single gap 62 that extends between ends of the single third plug segment 66.

Third cylindrical wall 60 is radially further from axis 8 than first wall 40 and second wall 50. In a specific embodiment, third cylindrical wall 60 comprises a plurality of third plug segments 66, each of which extend from end 68 to end 69, and the one or more gaps 62 are defined between ends 68, 69 of third plug segments 66. Third cylindrical wall 60, and more specifically third wall segments 66, extends circumferentially around axis 8, with the exception of one or more gaps 62 in third cylindrical wall 60. The one or more gaps 62 in third wall 60 provide fluid communication between outer surface 52 of second cylindrical wall 50 and ambient air external to closure 10 when the closure is tightly coupled to a container. Outer surface 52 of second cylindrical wall 50 faces radially away from center 18 of top panel 12. In an alternate embodiment, third wall 60 comprises a single third wall segment 66 and a single gap 62 between ends 68, 69 of third wall segment 66.

Figure 4:
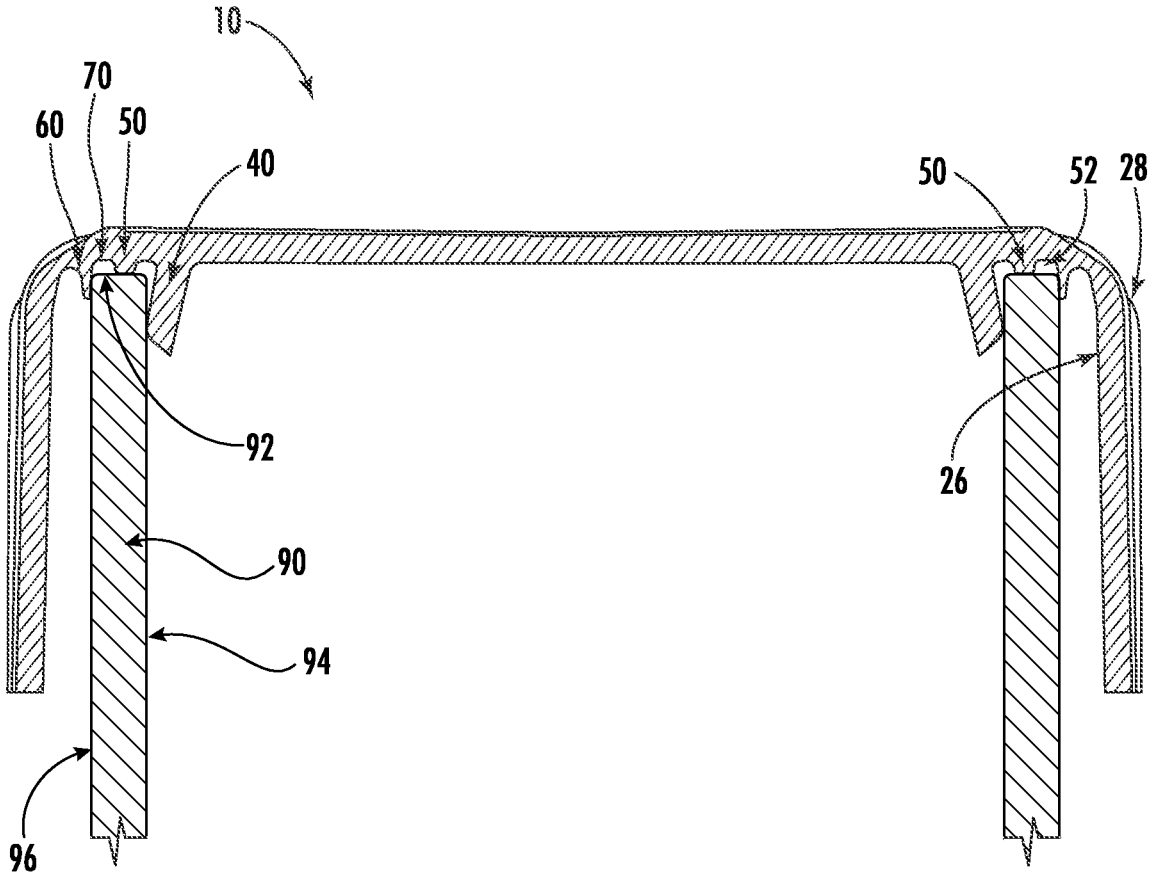
FIG. 4 is a cross-sectional view of the closure of FIG. 2 taken along the line 3-3 in FIG. 2, shown coupled to a container according to an exemplary embodiment.
Figure 5:
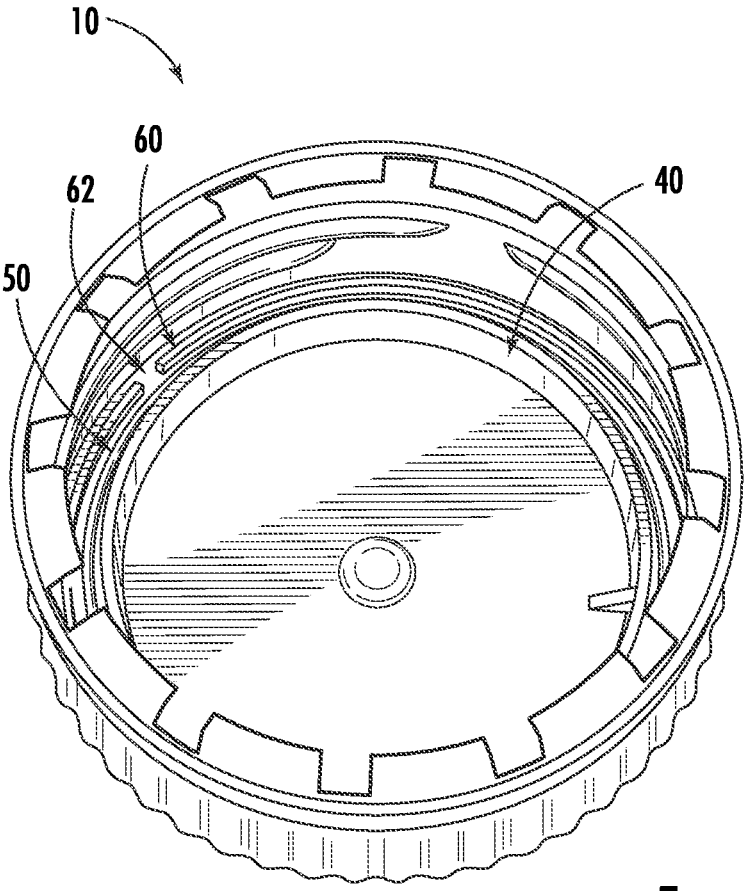
FIG. 5 is a perspective view of the closure of FIG. 1, according to an exemplary embodiment.
Figure 6:
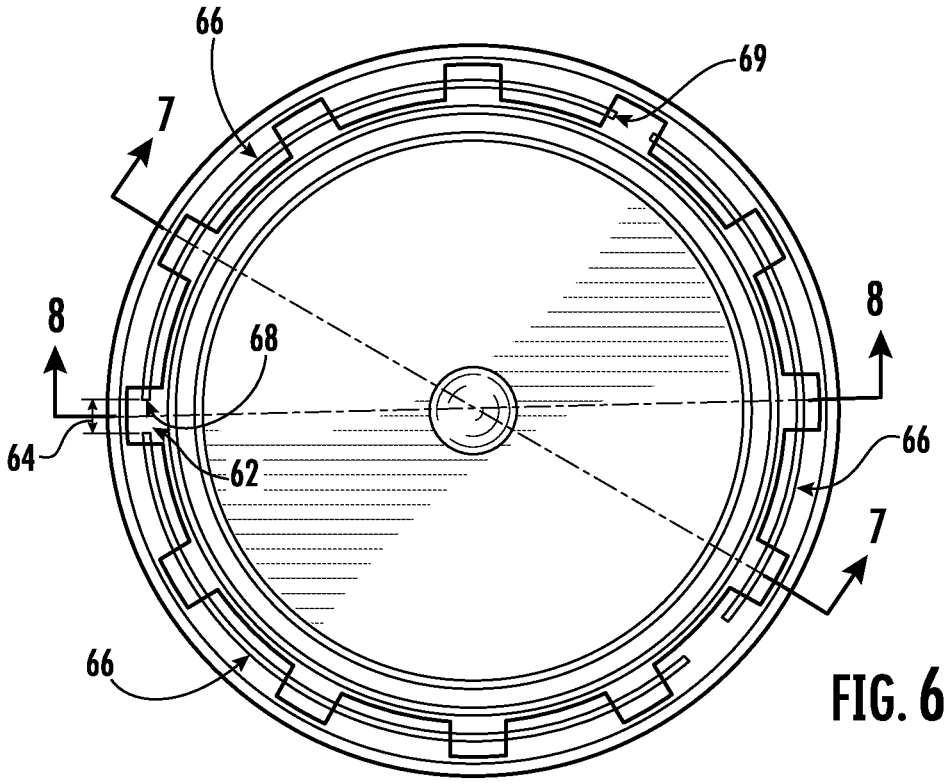
FIG. 6 is a bottom view of the closure of FIG. 1, according to an exemplary embodiment.
Figure 7:
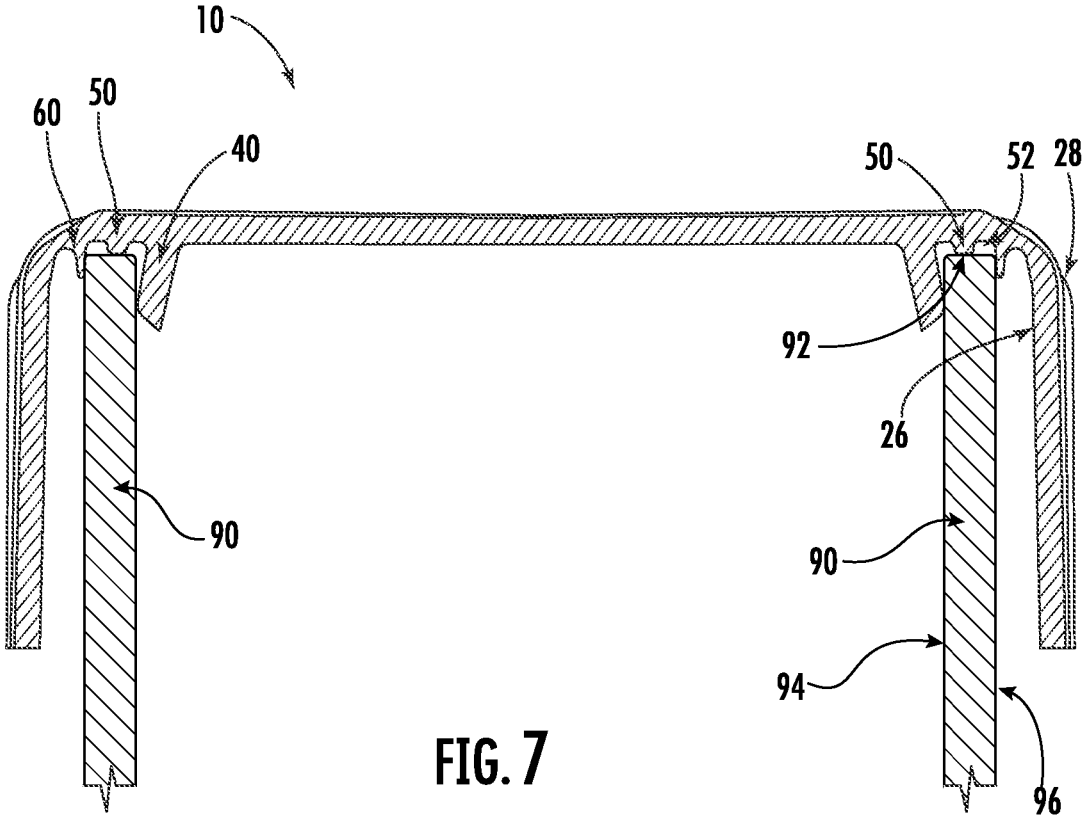
FIG. 7 is a cross-sectional view of the closure of FIG. 6 taken along the line 7-7 in FIG. 6 coupled to a container.
Figure 8:
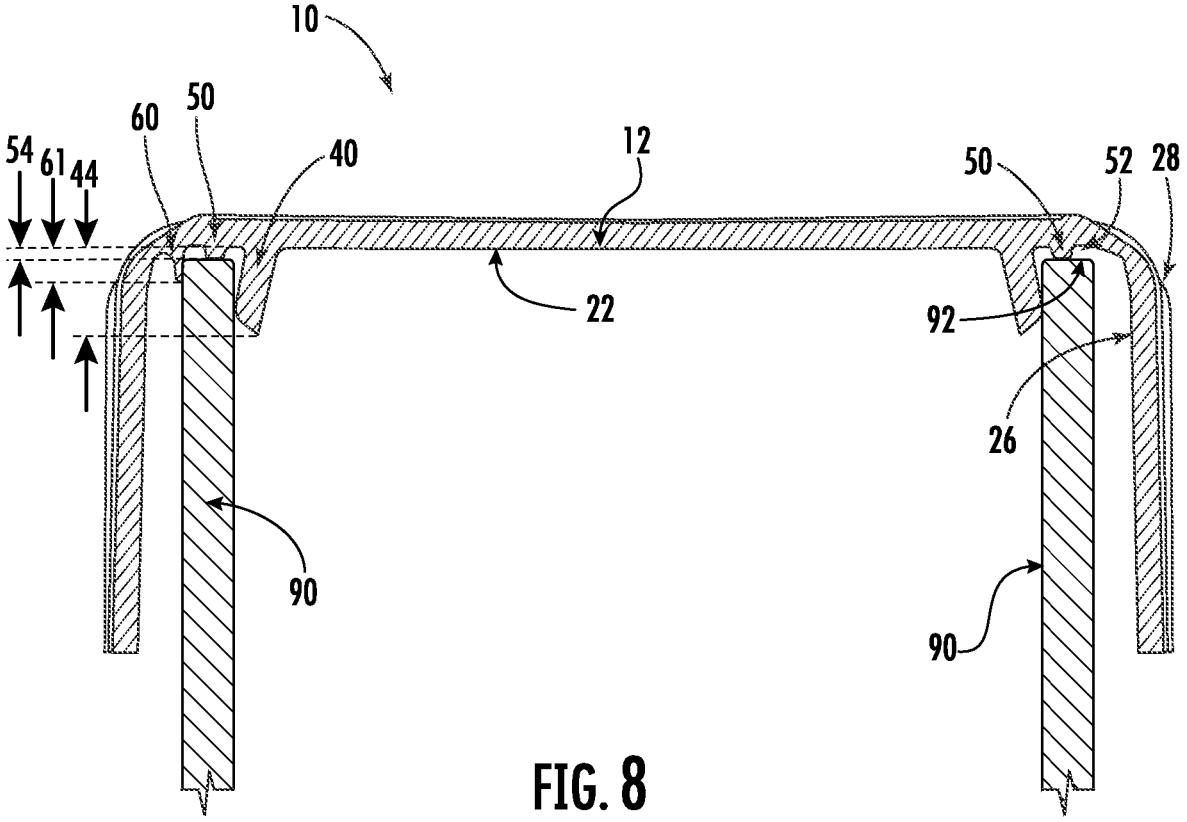
FIG. 8 is a cross-sectional view of the closure of FIG. 6 taken along the line 8-8 in FIG. 6 coupled to a container.

Referring to FIG. 4, in use first cylindrical wall 40 and the container neck to which closure 10 is affixed form a seal that encloses the contents of the container. For some contents, such as carbonated sodas, the pressure inside the container may increase in some circumstances (e.g., if the contents of the container are shaken, thereby allowing some carbonation to escape the liquid and take the form of a gas). In a specific embodiment, the increased pressure within the container exerts an upward force on a central portion 42 of top panel 12. Central portion 42 extends between interior edges of first cylindrical wall 40. When under pressure, central portion 42 deforms upwards, which deforms first cylindrical wall 40 towards center 18. As a result, the interface between the first cylindrical wall 40 and the container neck can be broken by a lesser force than would have been possible if top panel 12 did not deform.

In a specific embodiment, container includes a container neck 90 that defines an opening of the container, an interior surface 94 defined by the container neck 90, the interior surface 94 facing inwards, an exterior surface 96 defined by the container neck 90, the exterior surface 96 facing outwards and a top surface 92 defined by the container neck 90. The top surface 92 extends between the interior surface 94 and the exterior surface 96.

When closure 10 is coupled to container neck 90, first plug 40 interfaces with inner surface 94 of container neck 90, second plug 50 interfaces with top surface 92 of container neck 90, and third plug 60 interfaces with outer surface 96 of container neck 90.

Some contents of the container, such as gaseous carbon dioxide, thereby escapes the seal between first cylindrical wall 40 and the container neck and exerts pressure on the interface between second cylindrical wall 50 and the top of the container neck. When sufficient pressure is exerted on the interface between second cylindrical wall 50 and the top of the container neck, the interface between second cylindrical wall 50 and the container neck is compromised, thereby allowing some contents of the container to escape to the volume between outer surface 52 of second cylindrical wall 50 and third cylindrical wall 60.

Third cylindrical wall 60 defines one or more gaps 62. In a specific embodiment, the one or more gaps 62 extend radially through the entire third cylindrical wall 60, with respect to axis 8. In a specific embodiment, the one or more gaps 62 have a circumferential length 64 of less than 0.125 inches with respect to axis 8 and more specifically a circumferential length 64 of 0.062 inches with respect to axis 8.

Gaps 62 provide fluid communication between outer surface 52 of second cylindrical wall 50 and ambient air external to closure 10. As a result, container contents that have escaped the seal provided by second cylindrical wall 50 transit third cylindrical wall 60 and enter the ambient air outside of closure 10.

Figure 9:
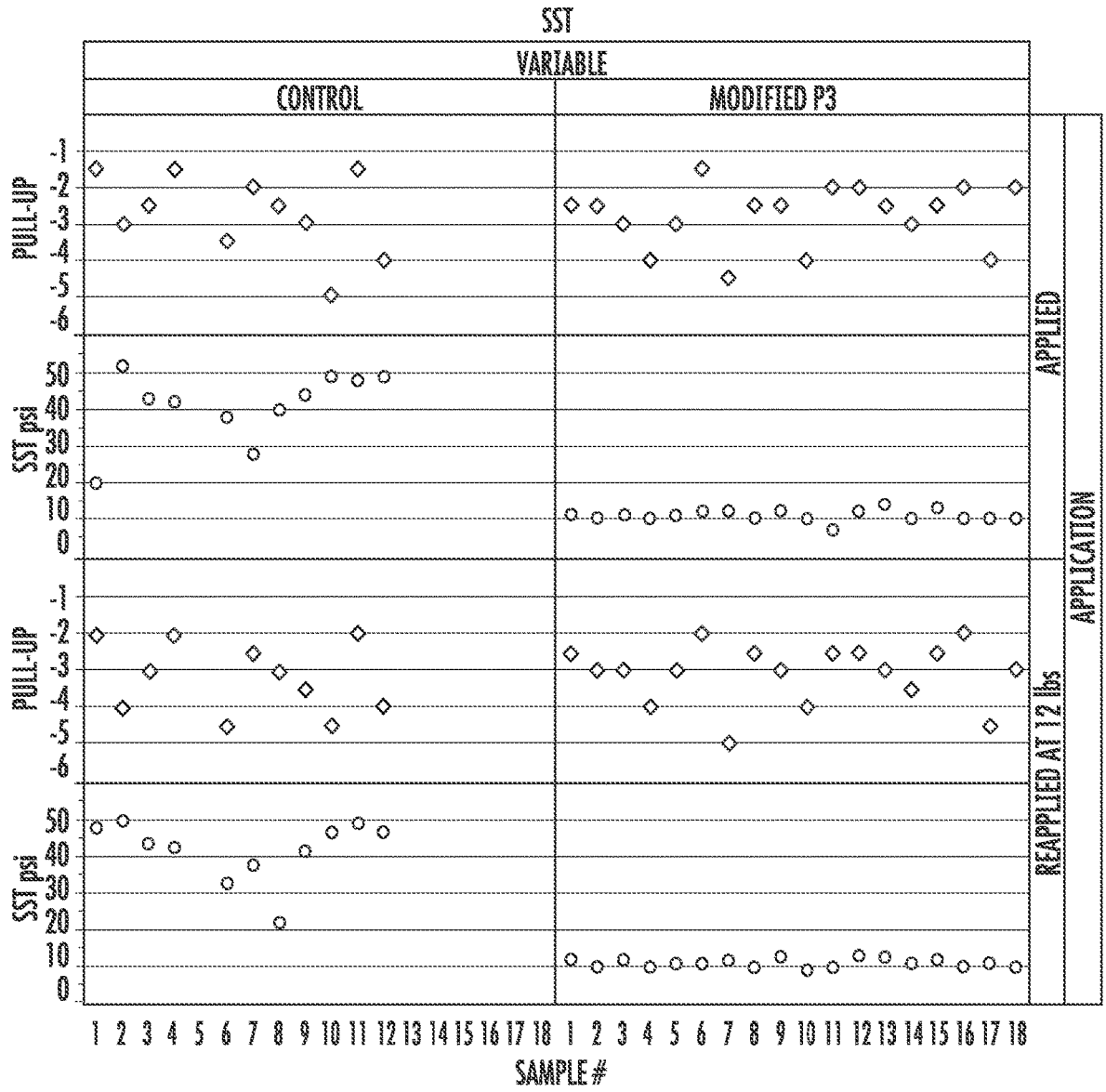
FIGS. 9-11 are charts of measurements of an exemplary embodiment of the closure of FIG. 1.
Figure 10:
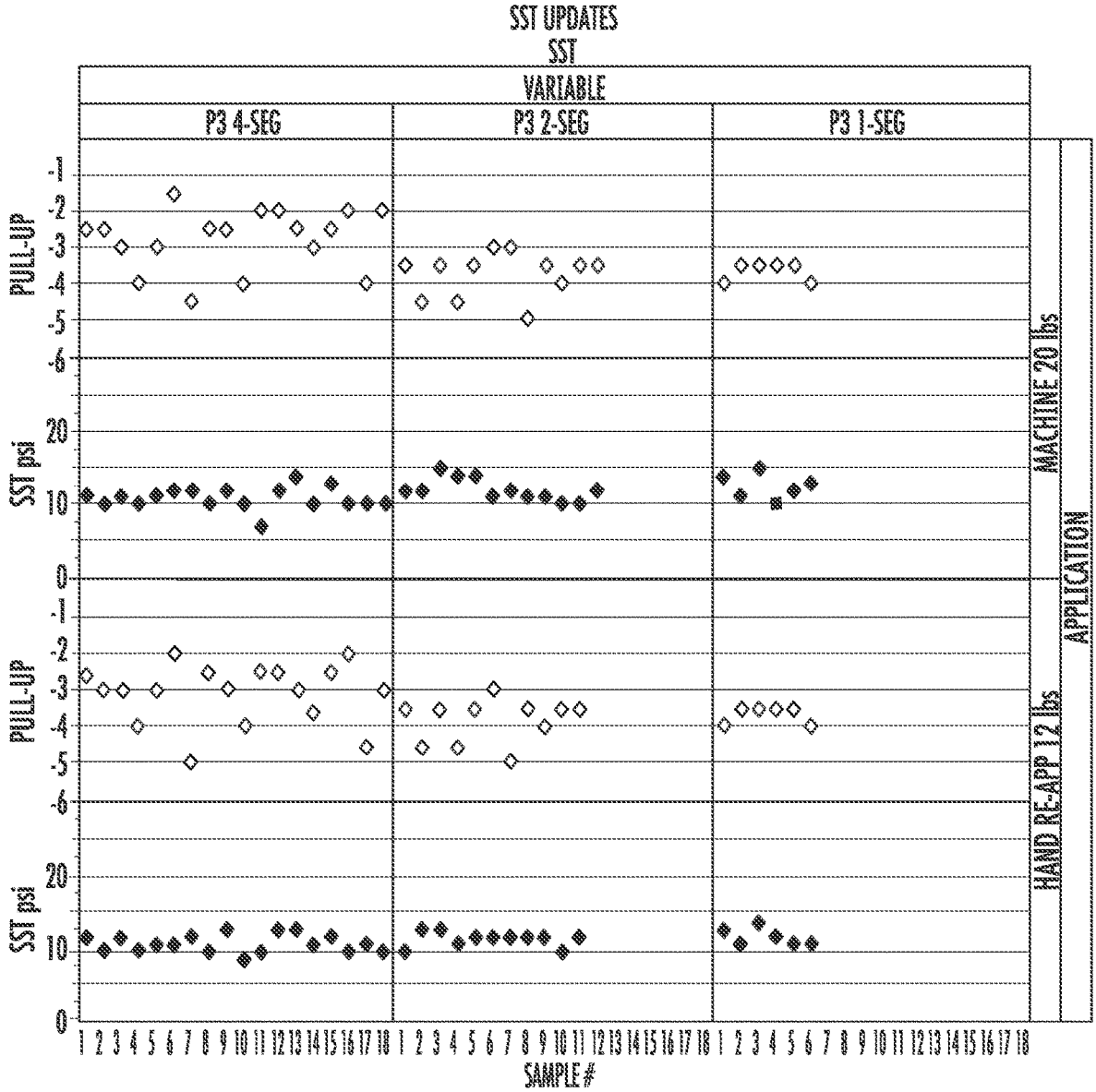
Figure 11:
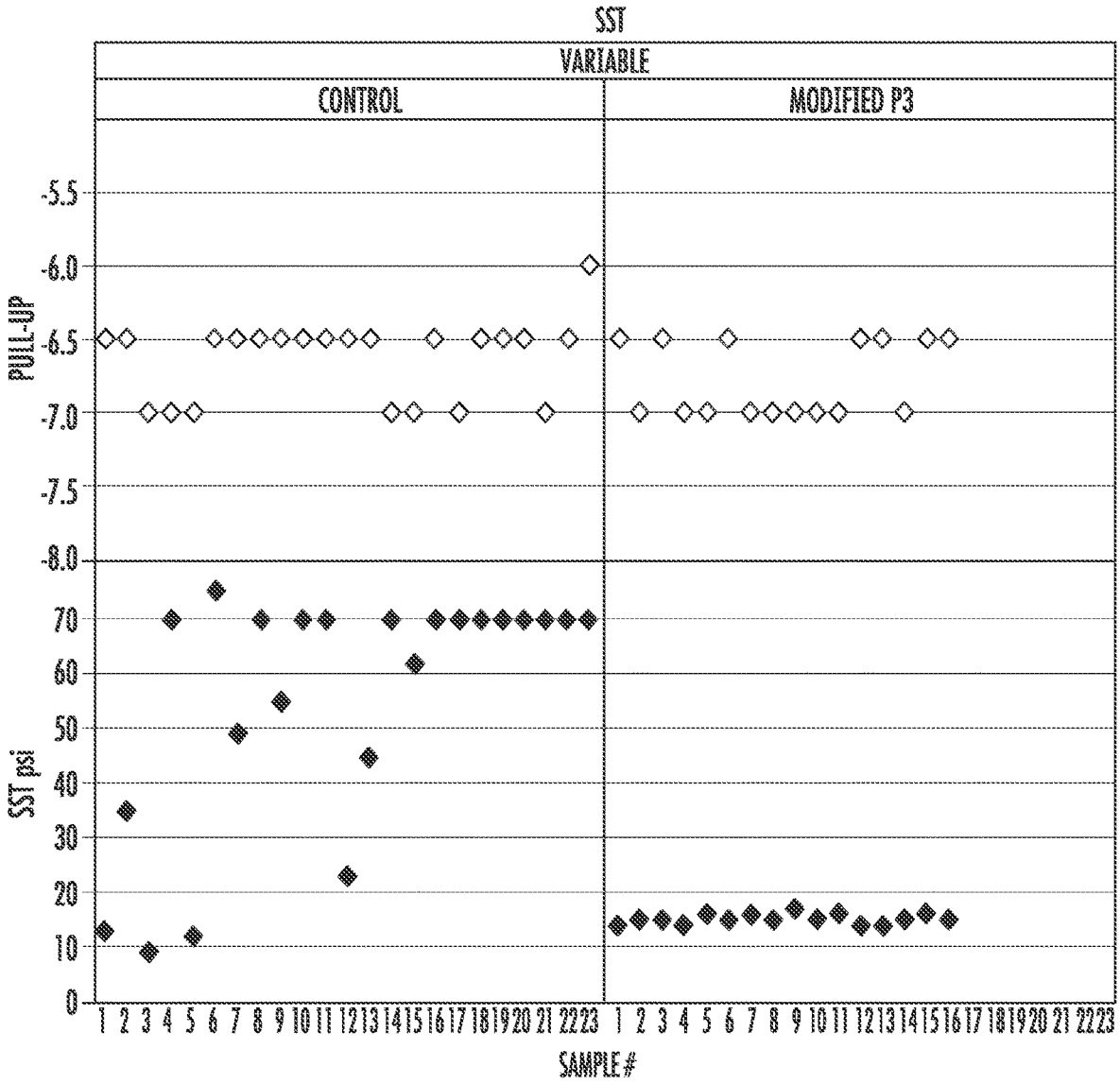
Figure 12:
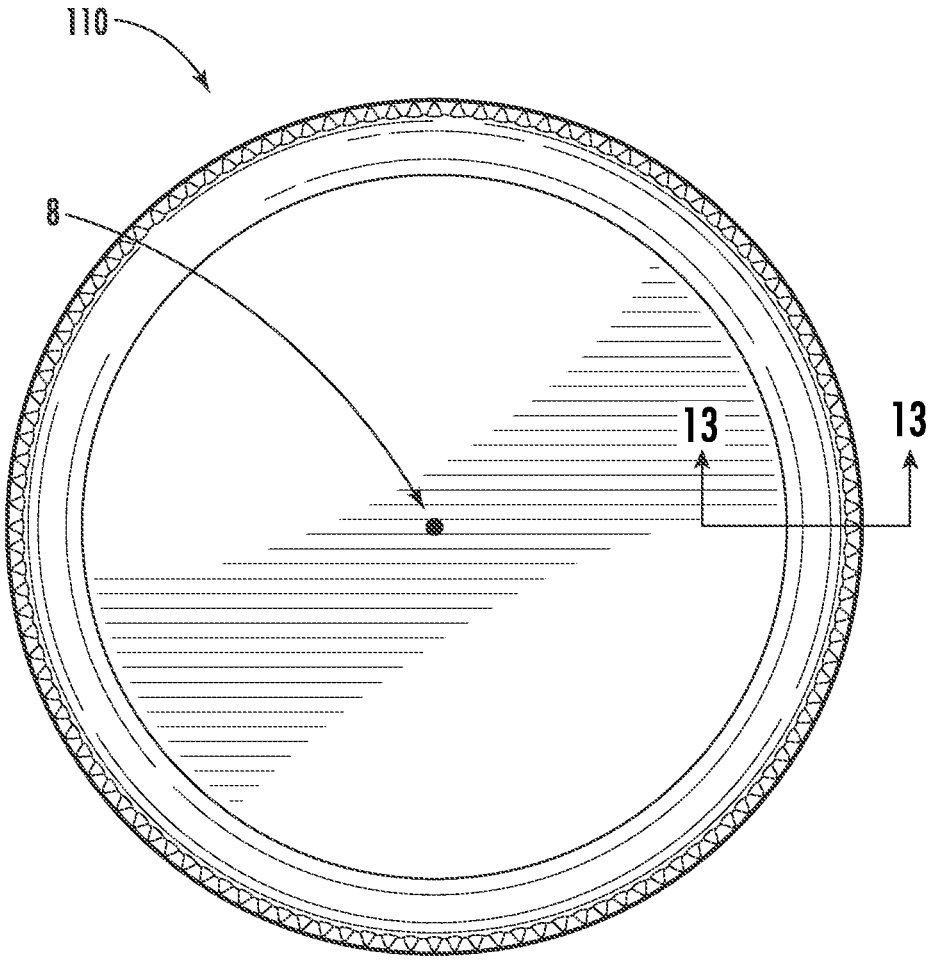
FIG. 12 is a top view of a closure, according to an exemplary embodiment.
Figure 13:
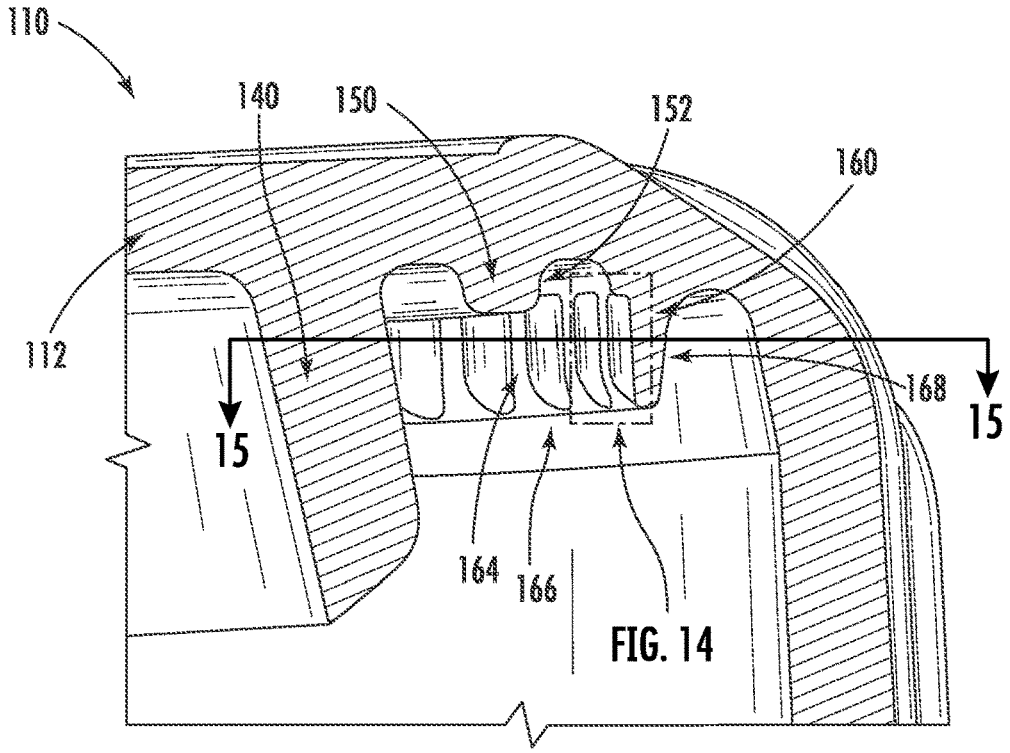
FIG. 13 is a detailed cross-section view of a portion of the closure of FIG. 12 taken alone line 13-13, according to an exemplary embodiment.
Figure 14:
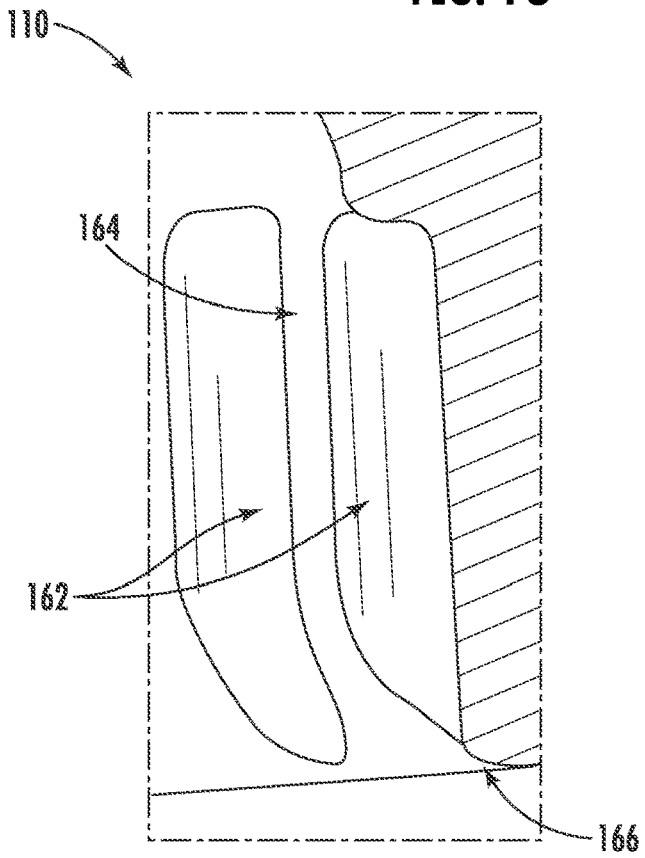
FIG. 14 is a detailed cross-section view of the portion of the closure depicted in FIG. 13, according to an exemplary embodiment.

Turning to FIGS. 9-11, depicted therein are various measurements of vent testing for a specific embodiment of closure 10. As can be seen, providing a fluid communication feature to third wall 60 results in a more uniform amount of pressure before the closure 10 relieves at least part of the pressure by permitting some contents to escape closure 10 and the container closure 10 is affixed to.

Turning to FIG. 9, pressure tests for an embodiment of a closure including the aspects of closure 10 were performed. As can be seen in the "Modified P3" column and the "SST psi" rows, the closure releases pressure at a lower variance of pressure differences and a lower average amount of pressure ("Modified P3" column) than when third wall 60 does not have any gaps 62. The difference in pressures is at least partially independent of how deep the closure is applied. Turning to FIG. 10, results of pressure tests for a closure with four gaps 62 (first column), two gaps 62 (second column) and one gap 62 (third column) are shown. Turning to FIG. 11, results of pressure tests for a closure including the aspects of closure 10 were performed, as can be seen in the "SST psi" row the closure releases pressure at a lower variance of pressure differences ("Modified P3" column) than when third wall 60 does not have any gaps 62.

Turning to FIGS. 12-15, various aspects of closure 110 are shown. Closure 110 is similar to closure 10 except for the differences described herein. Closure 110 includes top panel 112. Similar to closure 10, first wall 140 of closure 110 is closer to axis 8 than second wall 150, and second wall 150 is closer to axis 8 than third wall 160.

In closure 110, third wall 160 defines one or more recesses 162. In a specific embodiment, recesses 162 are defined by inward-facing surface 164 of third wall 160, and recesses 162 extend to be at least partially defined by downward-facing surface 166 of third wall 160. In various embodiments, recesses 162 do not extend through third wall 160, and thus are not defined by outward-facing surface 168 of third wall 160.

In a specific embodiment, third wall 160 of closure 110 includes a single recess 162. In various other embodiments, third wall 160 of closure 110 includes a plurality of recesses 162, and in some of those embodiments recesses 162 are equally spaced around third wall 160 with respect to axis 8.

In use, third wall 160 has a plurality of repeating recesses 162, which provide fluid communication between either side of third wall 160 (e.g., between outward-facing surface 152 of second wall 150 and ambient air external to closure 110). In a specific embodiment, recesses 162 within third wall 160 extend circumferentially around third wall 160 two (2) arcuate degrees with respect to axis 8. In a specific embodiment, recesses 162 within third wall 160 extend circumferentially around third wall 160 five (5) arcuate degrees with respect to axis 8.

In a specific embodiment, the closure 110 includes a generally circular top panel 112 having an upper surface, a lower surface and an outer periphery, a vertical axis around which the top panel 112 is centered, an outer cylindrical wall extending from an outer periphery of the top panel 112, a cylindrical first wall 140, a cylindrical second wall 150, and a cylindrical third wall 160.

Cylindrical first wall 140 extends a first depth downward from the lower surface of the top panel 112, and the first wall 140 is radially closer to the vertical axis than the outer periphery of the top panel. Cylindrical second wall 150 extends a second depth downward from the lower surface of the top panel 112, the second wall 150 is radially further from the vertical axis than the first wall 140, and the first depth of the first wall 140 is greater than the second depth of the second wall 150. Cylindrical third wall 160 extends a third depth downward from the lower surface of the top panel 112, the third wall 160 is radially further from the vertical axis than the second wall 150, the third depth of the third wall 160 is greater than the second depth of the second wall 150 and the third depth of the third wall 160 is less than the first depth of the first wall 140. The third wall 160 includes an interior surface that faces towards the vertical axis.

The interior surface of the third wall 160 defines a recess. The recess provides fluid communication between the second plug and ambient air external to the outer cylindrical wall. In various embodiments, the third wall 160 comprises a plurality of recesses. In a specific embodiment, the recess(es) extend radially outward from the interior surface of the third wall 160 away from the axis (e.g., towards an outer surface of the third wall 160 that faces away from the axis).

Figure 15:
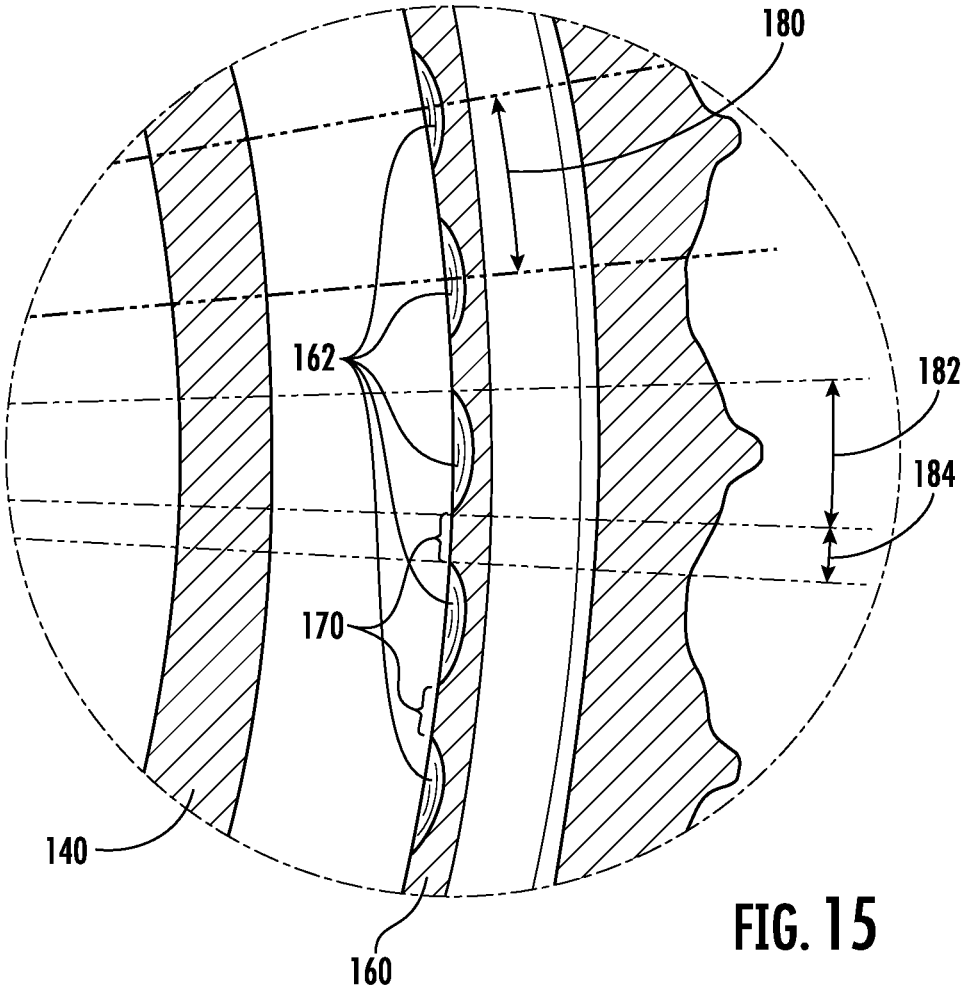
FIG. 15 is a detailed cross-section view of the portion of the closure depicted in FIG. 13 along line 15-15, according to an exemplary embodiment.

Referring to FIG. 15, recesses 162 extend circumferentially around closure 110 distance 182 within third plug 160 with respect to the vertical axis of closure 110, and recesses 162 are separated by spaces 170 that extend circumferentially around closure 110 distance 184 with respect to the vertical axis of closure 110. Thus, collectively a single recess 162 and a single space 170 extend circumferentially around closure 110 distance 180 with respect to the vertical axis of closure 110.

In a specific embodiment, distance 182 of recesses 162 is between 2 degrees and 6 degrees, and more specifically between 3 degrees and 5 degrees, and more specifically is 3.6 degrees. In a specific embodiment, distance 184 of spaces 170 is between 0.5 degrees and 4 degrees, and more specifically between 1 degrees and 2 degrees, and more specifically is 1.4 degrees. In a specific embodiment, distance 180 is between 3 degrees and 10 degrees, and more specifically between 4 degrees and 7 degrees, and more specifically is 5 degrees.

In various embodiments, closures include any number of recesses 162, such as between 1 and the number of recesses 162 that can fit within inner surface of the third plug. In a specific embodiment, closure 110 includes eight recesses 162.

Figure 16:
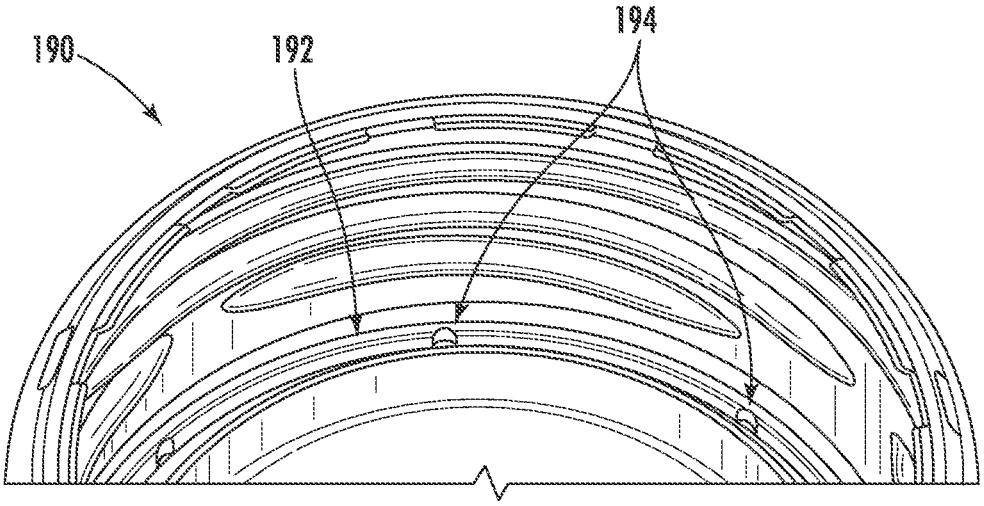
FIG. 16 is a detailed perspective view of a closure, according to an exemplary embodiment.

Turning to FIG. 16, various aspects of closure 190 are shown. Closure 190 is similar to closure 110 except for the differences described herein. Specifically, the difference between closure 190 and closure 110 is that closure 190 includes fewer recesses 194 in third wall 192. In a specific embodiment, third wall 192 of closure 190 includes twelve (12) recesses 194.

Figure 17:
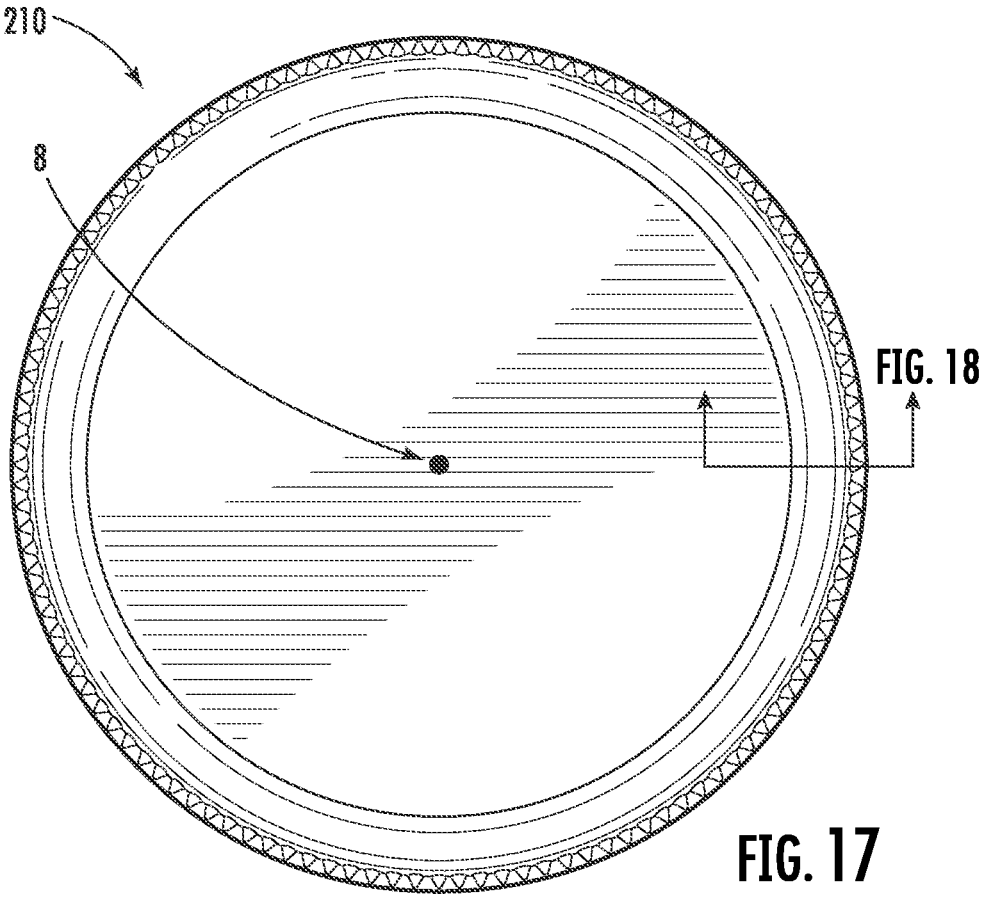
FIG. 17 is a top view of a closure, according to an exemplary embodiment.
Figure 18:
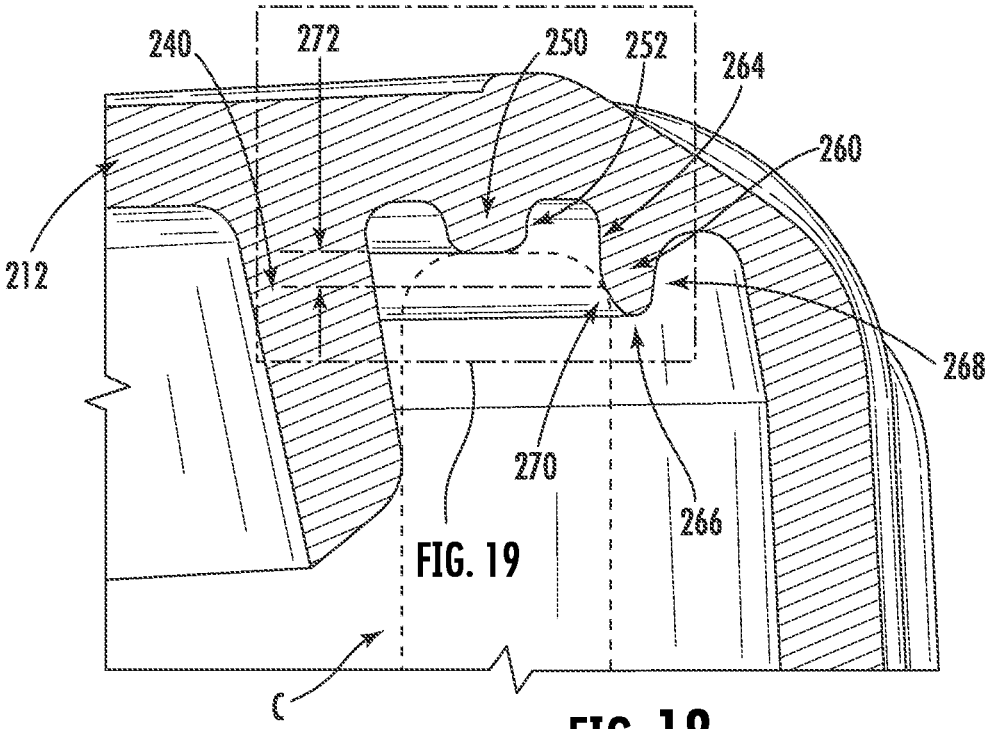
FIG. 18 is a detailed cross-section view of the closure of FIG. 17, according to an exemplary embodiment.
Figure 19:
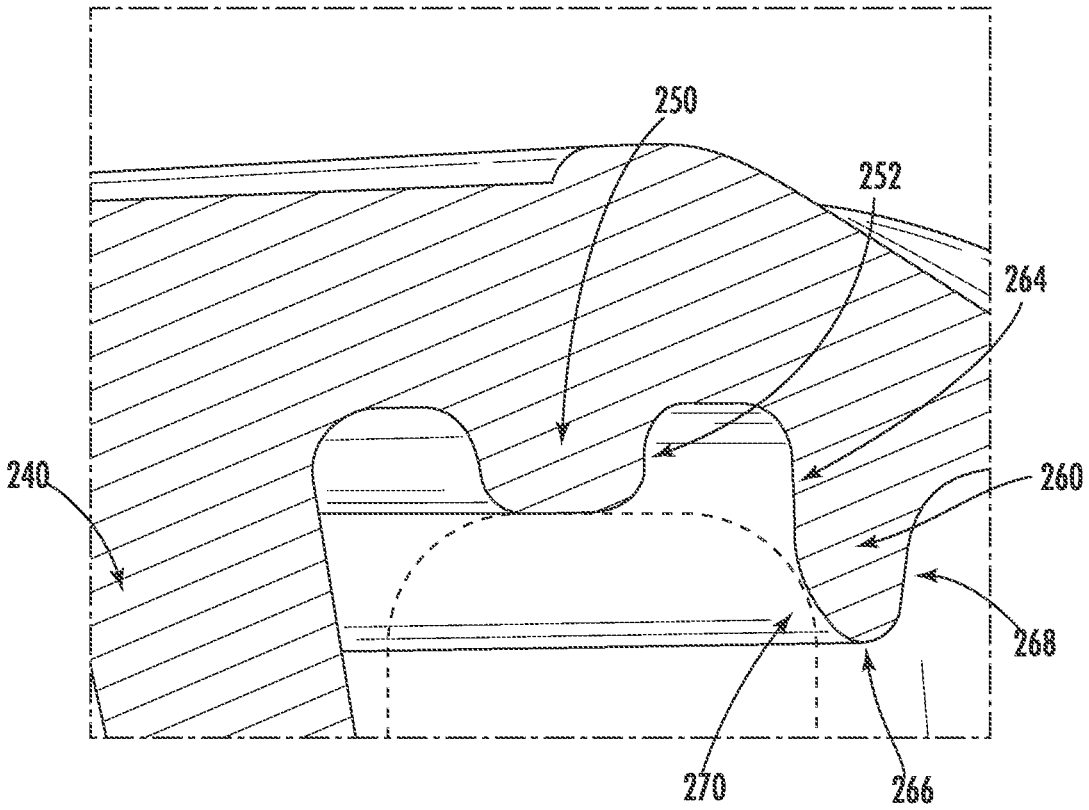
FIG. 19 is a detailed view of the cross-section of FIG. 18, according to an exemplary embodiment.

Turning to FIGS. 17-19, various aspects of closure 210 are shown. Closure 210 is similar to closure 110 and closure 10 except for the differences described herein. Closure 210 includes top panel 212. Similar to closure 10 and closure 110, first wall 240 of closure 210 is closer to axis 8 than second wall 250, and second wall 250 is closer to axis 8 than third wall 260.

In use, inner corner 270 of third wall 260 interfaces with a corner of the container neck C to provide a supplemental seal for contents in the container. Inward-facing surface 264 of third wall 260 faces towards axis 8, outward-facing surface 268 of third wall 260 away from axis 8, and bottom-facing surface 266 of third wall 260 faces away from top panel 212. Inner corner 270 of third wall 260 extends between inward-facing surface 264 and bottom-facing surface 266. In a specific embodiment, corner 270 extends depth 272 below second wall 250. In various embodiments, the length of depth 272 varies in relation to the outside crown radius of the finish.

In a specific embodiment, a closure 210 includes a generally circular top panel having an upper surface, a lower surface and an outer periphery, a vertical axis around which the top panel is centered, an outer cylindrical wall extending from an outer periphery of the top panel, a cylindrical first plug, a cylindrical second plug, and a cylindrical third plug. The cylindrical first plug extends a first depth downward from the lower surface of the top panel, and the first plug is radially closer to the vertical axis than the outer periphery of the top panel. The cylindrical second plug extends a second depth downward from the lower surface of the top panel, the second plug is radially further from the vertical axis than the first plug, and the first depth of the first plug is greater than the second depth of the second plug. The cylindrical third plug extends a third depth downward from the lower surface of the top panel, the third plug is radially further from the vertical axis than the second plug, and the third depth of the third plug is greater than the second depth of the second plug and the third depth of the third plug is less than the first depth of the first plug.

The third plug includes an interior surface that faces towards the vertical axis. The third plug includes a lower surface that faces away from the top panel. The third plug includes a corner surface that extends between the interior surface and the lower surface. The corner surface is configured to interface against a corner of a container neck when the closure is affixed to the container neck.

Figure 20:
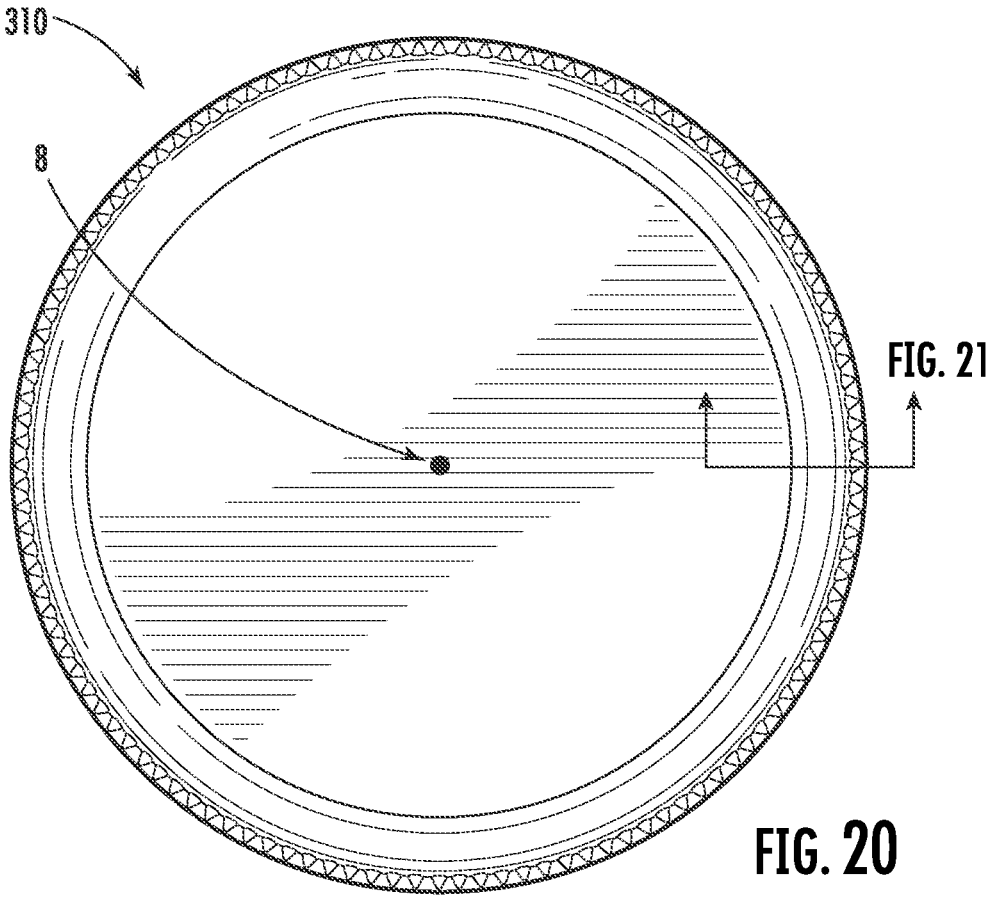
FIG. 20 is a top view of a closure, according to an exemplary embodiment.
Figure 21:
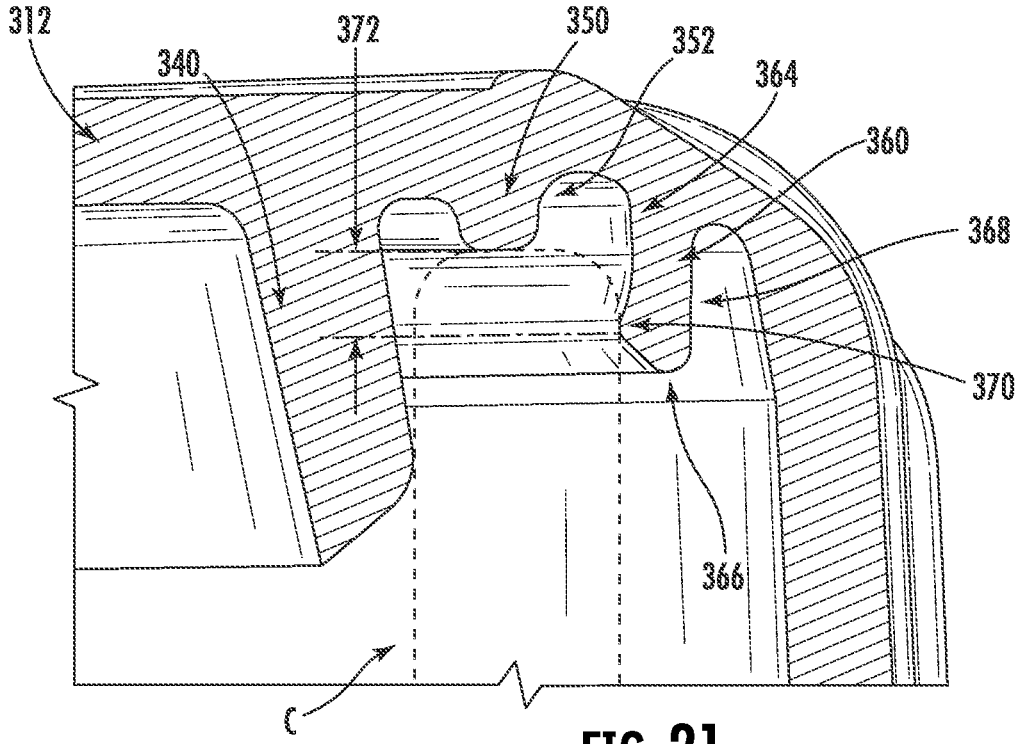
FIG. 21 is a detailed cross-section view of the closure of FIG. 19, according to an exemplary embodiment.

Turning to FIGS. 20-21, various aspects of closure 310 are shown. Closure 310 is similar to closure 210, closure 110 and closure 10 except for the differences described herein. Closure 310 includes top panel 312. Similar to closure 10, closure 110 and closure 210, first wall 340 of closure 310 is closer to axis 8 than second wall 350, and second wall 350 is closer to axis 8 than third wall 360.

Inward-facing surface 364 of third wall 360 faces towards axis 8, outward-facing surface 368 of third wall 360 away from axis 8, and bottom-facing surface 366 of third wall 360 faces away from top panel 312. Protrusion 370 extends inwardly from third wall 360 towards axis 8, and as a result inward-facing surface 364 includes both a cylindrical portion above protrusion 370 and an angled portion over protrusion 370. In use, protrusion 370 interfaces against outer surface of container neck C to provide a supplemental seal for contents in the container. In a specific embodiment, protrusion 370 extends depth 372 below second wall 350. In various embodiments, the length of depth 372 varies in relation to the outside crown radius of the finish.

In a specific embodiment, closure 310 includes a generally circular top panel having an upper surface, a lower surface and an outer periphery, a vertical axis around which the top panel is centered, an outer cylindrical wall extending from an outer periphery of the top panel, a cylindrical first plug, a cylindrical second plug, and a cylindrical third plug. The cylindrical first plug extends a first depth downward from the lower surface of the top panel, and the first plug is radially closer to the vertical axis than the outer periphery of the top panel. The cylindrical second plug extends a second depth downward from the lower surface of the top panel, the second plug is radially further from the vertical axis than the first plug, and the first depth of the first plug is greater than the second depth of the second plug. The cylindrical third plug extends a third depth downward from the lower surface of the top panel, the third plug is radially further from the vertical axis than the second plug, and the third depth of the third plug is greater than the second depth of the second plug and the third depth of the third plug is less than the first depth of the first plug.

The third plug includes an interior surface that faces towards the vertical axis. The third plug includes a protrusion that extends from a lower portion of the third plug towards the axis. In a specific embodiment, the protrusion extends radially inward towards the central axis of closure 310 from the lower portion of the third plug.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein the article "a" is intended to include one or more than one component or element, and is not intended to be construed as meaning only one.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another, or with the two members and any additional member being attached to one another. Such joining may be permanent in nature or alternatively may be removable or releasable in nature. Various embodiments of the invention relate to any combination of any of the features, and any such combination of features may be claimed in this or future applications. Any of the features, elements, or components of any of the exemplary embodiments discussed above may be utilized alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

What is claimed is:

1. A closure comprising:

a generally circular top panel having an upper surface, a lower surface and an outer periphery;

a vertical axis around which the top panel is centered;

an outer cylindrical wall extending from an outer periphery of the top panel;

a cylindrical first plug extending a first depth downward from the lower surface of the top panel, the first plug being radially closer to the vertical axis than the outer periphery of the top panel;

a cylindrical second plug extending a second depth downward from the lower surface of the top panel, the second plug being radially further from the vertical axis than the first plug, the first depth of the first plug being greater than the second depth of the second plug;

a plurality of third plug segments extending a third depth downward from the lower surface of the top panel, the plurality of third plug segments being radially further from the vertical axis than the second plug, the third depth being greater than the second depth of the second plug and the third depth being less than the first depth of the first plug; and a gap defined between two of the plurality of third plug segments, wherein the gap provides fluid communication between the second plug and ambient air external to the outer cylindrical wall when the closure is tightly coupled to a container.

2. The closure of claim 1, wherein the gap defines a circumferential length less than 0.125 inches with respect to the vertical axis.

3. The closure of claim 1, wherein each of the plurality of third plug segments extend circumferentially around the closure at the same radius from the vertical axis.

4. The closure of claim 1, wherein the gap is a first gap, the closure comprising a plurality of gaps including the first gap, wherein each gap of the plurality of gaps is defined between two of the plurality of third plug segments.

5. The closure of claim 4, wherein the plurality of gaps comprise three gaps that provide fluid communication between the second plug and ambient air external to the outer cylindrical wall when the closure is tightly coupled to a container.

6. The closure of claim 4, wherein the plurality of gaps are evenly circumferentially spaced around the closure with respect to the vertical axis.

7. The closure of claim 1, wherein each of the plurality of third plug segments are the same radius from the vertical axis.

8. A closure comprising:

a generally circular top panel having an upper surface, a lower surface and an outer periphery;

a vertical axis around which the top panel is centered;

an outer cylindrical wall extending from an outer periphery of the top panel;

a cylindrical first plug extending a first depth downward from the lower surface of the top panel, the first plug being radially closer to the vertical axis than the outer periphery of the top panel;

a cylindrical second plug extending a second depth downward from the lower surface of the top panel, the second plug being radially further from the vertical axis than the first plug, the first depth of the first plug being greater than the second depth of the second plug;

a third plug segment extending a third depth downward from the lower surface of the top panel, the third plug segment being radially further from the vertical axis than the second plug, the third depth being greater than the second depth of the second plug and the third depth being less than the first depth of the first plug; and a gap defined by the third plug segment, wherein the gap provides fluid communication between the second plug and ambient air external to the outer cylindrical wall.

9. The closure of claim 8, wherein the gap is between ends of the third plug segment.

10. The closure of claim 9, wherein the gap defines a circumferential length less than 0.125 inches with respect to the vertical axis.

11. The closure of claim 8, wherein the third plug segment extends from the lower surface of the top panel circumferentially around the closure at the same radius from the vertical axis.

12. The closure of claim 8, wherein the third plug segment extends circumferentially around the closure at the same radius from the vertical axis.

13. A combination comprising:

a container comprising:

a container neck that defines an opening;

an interior surface defined by the container neck, the interior surface facing inwards;

an exterior surface defined by the container neck, the exterior surface facing outwards; and a top surface defined by the container neck, the top surface extending between the interior surface and the exterior surface; and a closure affixed to the container neck, the closure comprising:

a generally circular top panel having an upper surface, a lower surface and an outer periphery;

a vertical axis around which the top panel is centered;

an outer cylindrical wall extending from an outer periphery of the top panel;

a cylindrical first plug extending a first depth downward from the lower surface of the top panel, the first plug being radially closer to the vertical axis than the outer periphery of the top panel;

a plurality of third plug segments extending a third depth downward from the lower surface of the top panel, the plurality of third plug segments being radially further from the vertical axis than the first plug, the third depth being less than the first depth of the first plug; and a gap defined between two of the plurality of third plug segments, wherein the gap provides fluid communication between the top surface of the container neck and ambient air external to the outer cylindrical wall when the closure is tightly coupled to a container.

14. The combination of claim 13, wherein the gap defines a circumferential length less than 0.125 inches with respect to the vertical axis.

15. The combination of claim 13, wherein the gap is a first gap, the closure comprising a plurality of gaps including the first gap, wherein each gap of the plurality of gaps is defined between two of the plurality of third plug segments.

16. The combination of claim 15, wherein the plurality of gaps comprise three gaps that provide fluid communication between the top surface of the container neck and ambient air external to the outer cylindrical wall when the closure is tightly coupled to a container.

17. The combination of claim 15, wherein the plurality of gaps are evenly circumferentially spaced around the closure with respect to the vertical axis.

18. The combination of claim 15, wherein each of the plurality of third plug segments extend circumferentially around the closure at the same radius from the vertical axis.

19. The combination of claim 13, the closure further comprising a cylindrical second plug extending a second depth downward from the lower surface of the top panel, the second plug being radially further from the vertical axis than the first plug and radially closer to the vertical axis than the third plug, the second plug interfacing with the top surface of the container neck.

20. The combination of claim 19, the second plug interfacing with the top surface of the container neck.

* * * * *